US007125486B1

(12) United States Patent
Chuang

(10) Patent No.: US 7,125,486 B1
(45) Date of Patent: Oct. 24, 2006

(54) DEVICE FOR REMOVING SMALL SOLIDS FROM WATER IN CANAL

(75) Inventor: Hsu-Chen Chuang, Shindian (TW)

(73) Assignee: Taiwan Water & Soil Instrumentation, Inc. (TW)

( * ) Notice: Subject to any disclaimer, the term of this patent is extended or adjusted under 35 U.S.C. 154(b) by 0 days.

(21) Appl. No.: 11/265,757

(22) Filed: Nov. 2, 2005

(51) Int. Cl.
*B01D 33/15* (2006.01)
*E02B 5/08* (2006.01)

(52) U.S. Cl. ..... 210/155; 210/156; 210/242.1; 210/328

(58) Field of Classification Search ..... 210/155, 210/156
See application file for complete search history.

(56) References Cited

U.S. PATENT DOCUMENTS

| | | | | | |
|---|---|---|---|---|---|
| 788,511 | A * | 5/1905 | Besseberg | 210/354 |
| 924,721 | A * | 6/1909 | Arbuckle | 210/328 |
| 1,097,896 | A * | 5/1914 | Trent | 210/328 |
| 1,276,374 | A * | 8/1918 | Keller | 210/157 |
| 1,574,051 | A * | 2/1926 | Morris | 210/325 |
| 1,663,398 | A * | 3/1928 | Cooke | 210/157 |
| 1,687,863 | A * | 10/1928 | Graham | 210/203 |
| 2,322,415 | A * | 6/1943 | Buckbee | 210/330 |
| 3,221,887 | A * | 12/1965 | Schade | 210/327 |
| 4,233,892 | A * | 11/1980 | Hawkins | 99/421 M |
| 4,270,056 | A * | 5/1981 | Wright | 290/54 |
| 4,676,893 | A * | 6/1987 | Travade et al. | 210/157 |
| 6,029,688 | A * | 2/2000 | Kaufman | 137/99 |
| 6,616,403 | B1 * | 9/2003 | Smith et al. | 415/3.1 |
| 2004/0262204 | A1 * | 12/2004 | Buckett | 210/107 |

* cited by examiner

*Primary Examiner*—Robert James Popovics

(57) ABSTRACT

There is disclosed a device for removing small solids from water. The device includes an axle and a plurality of rotational filtering units installed on the axle. While rushed and hence rotated by water and small solids, the rotational filtering units filter the small solids. The device consumes little energy other than the water provides.

13 Claims, 5 Drawing Sheets

DEVICE FOR REMOVING SMALL SOLIDS FROM WATER IN CANAL

BACKGROUND OF INVENTION

1. Field of Invention

The present invention relates to a device for removing small solids from water in a canal in emergency such as during or immediately after a rainstorm when the water is too turbid for a waterworks to process.

2. Related Prior Art

In or immediately after a typhoon or rainstorm, tons of rocks and sand are washed to rivers and reservoirs so that water bodies used as water sources become gravely turbid. Time is often not enough for the gravely turbid water to deposit before it reaches a water treatment plant through a canal. In the water treatment plant, the gravely turbid water contains too many solids for normal equipment to treat and causes the normal equipment to malfunction. In the worst case, the water treatment plant has to be shut down.

There have been various devices for removing solids from water in a canal. However, the conventional devices include screws and motors for driving the screws. It requires a lot of energy to operate each of the foregoing conventional devices. The energy is generally provided in the form of electricity. In a blackout of the electricity system or failure of the motors, the devices will be shut down and block the stream. This could be even worse than the solids could do. The conventional devices can be seen in U.S. Pat. Nos. 4,836,919, 5,110,461, 5,296,136, 5,372,713, 5,552,044, 5,593,597, 5,798,038 and 6,733,663 for example.

The present invention is therefore intended to obviate or at least alleviate the problems encountered in prior art.

SUMMARY OF INVENTION

It is the primary objective of the present invention to provide a device for removing small solids from water in a canal that device consumes little energy other than the water provides.

According to the present invention, a device for removing small solids from water in a canal includes an axle and a plurality of rotational filtering units installed on the axle. While impinged and therefore rotated by the water and small solids, the rotational filtering units filter the small solids.

Other objects, advantages and novel features of the present invention will become more apparent from the following detailed description referring to the attached drawings.

BRIEF DESCRIPTION OF DRAWINGS

The present invention will be described through detailed illustration of the preferred embodiment referring to the drawings.

DETAILED DESCRIPTION OF PREFERRED EMBODIMENT

Figure 1:
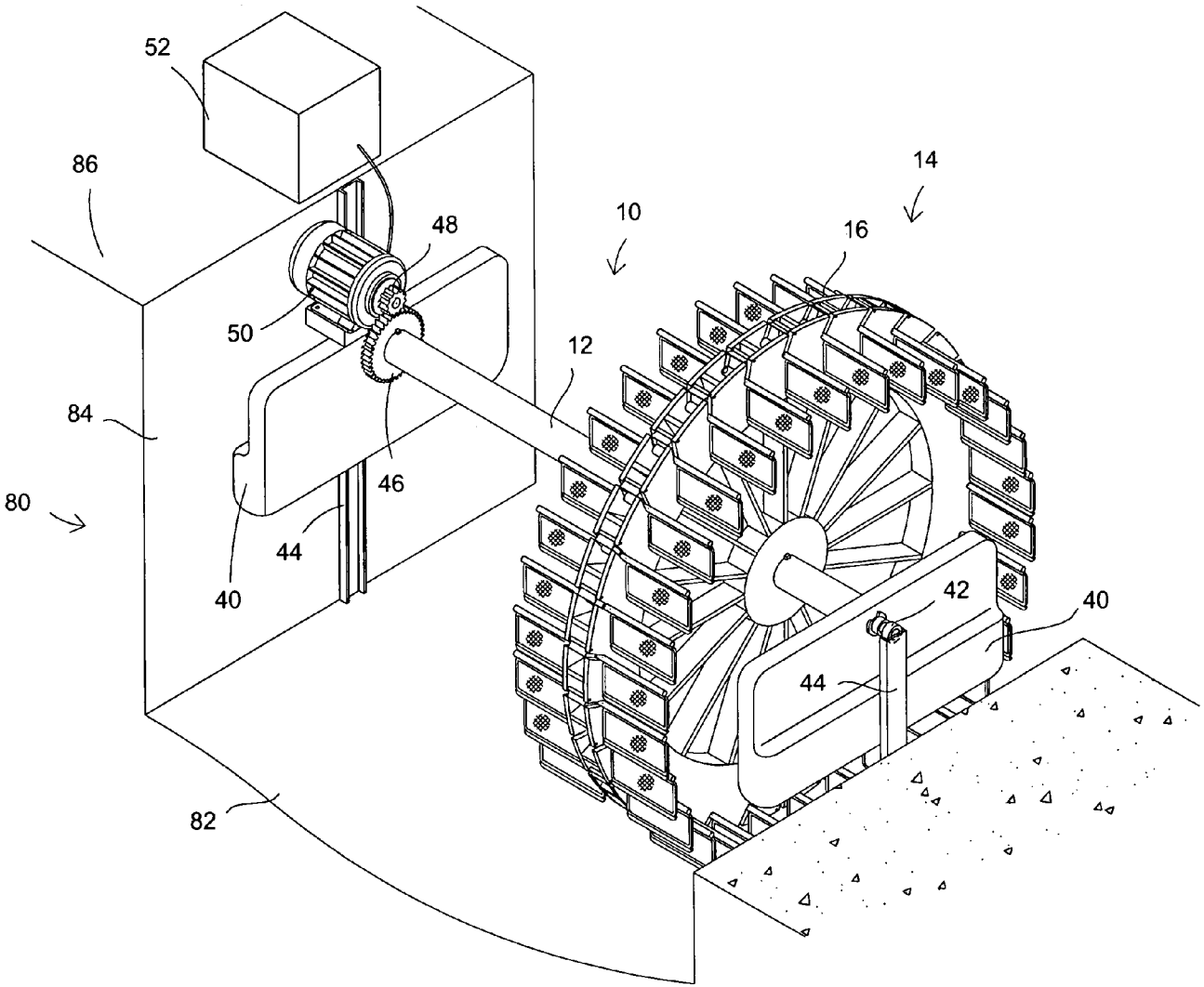
FIG. 1 is a perspective view of a device for removing small solids from water in a canal according to the present invention.
Figure 2:
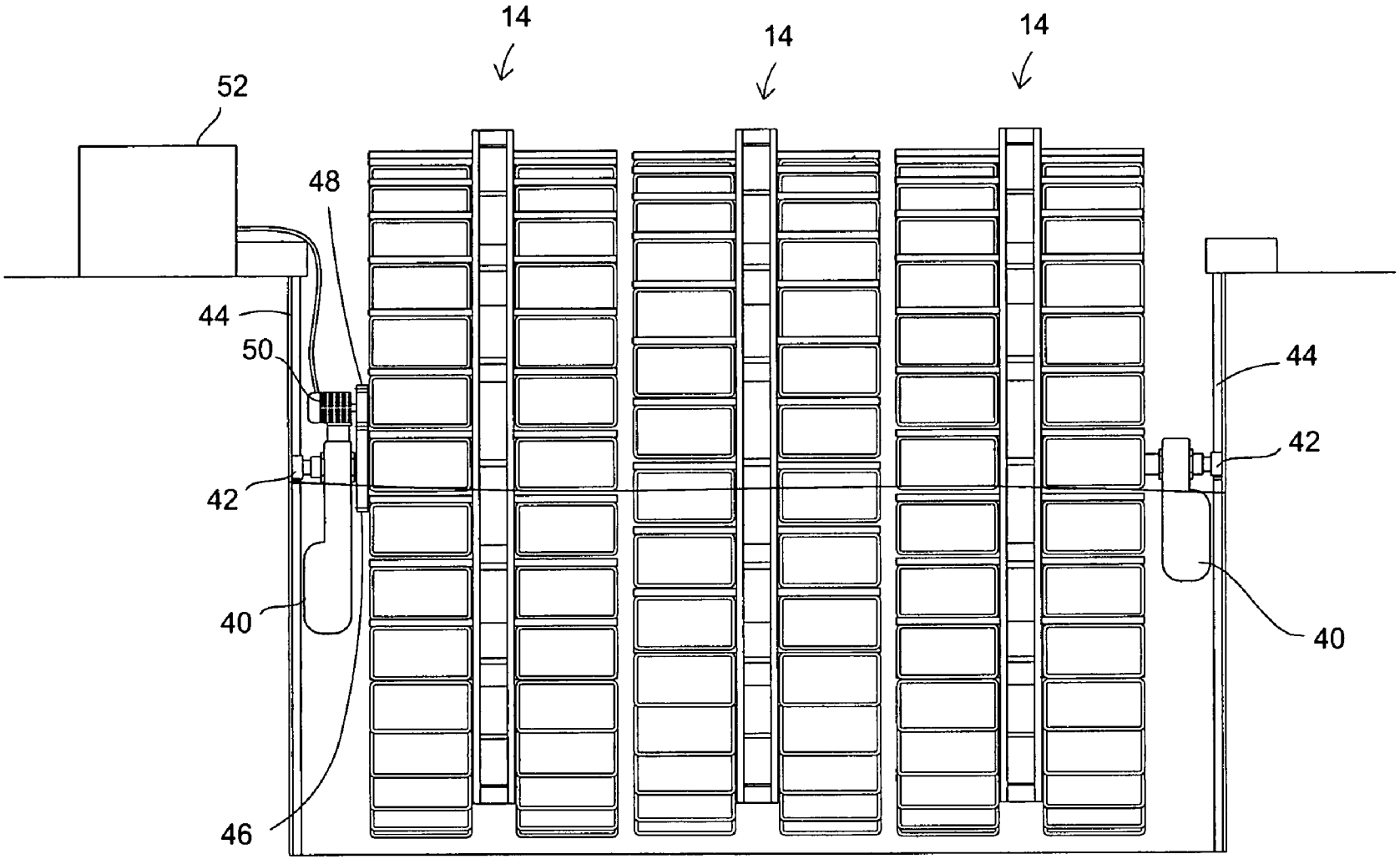
FIG. 2 is a rear view of the device shown in FIG. 1.
Figure 3:
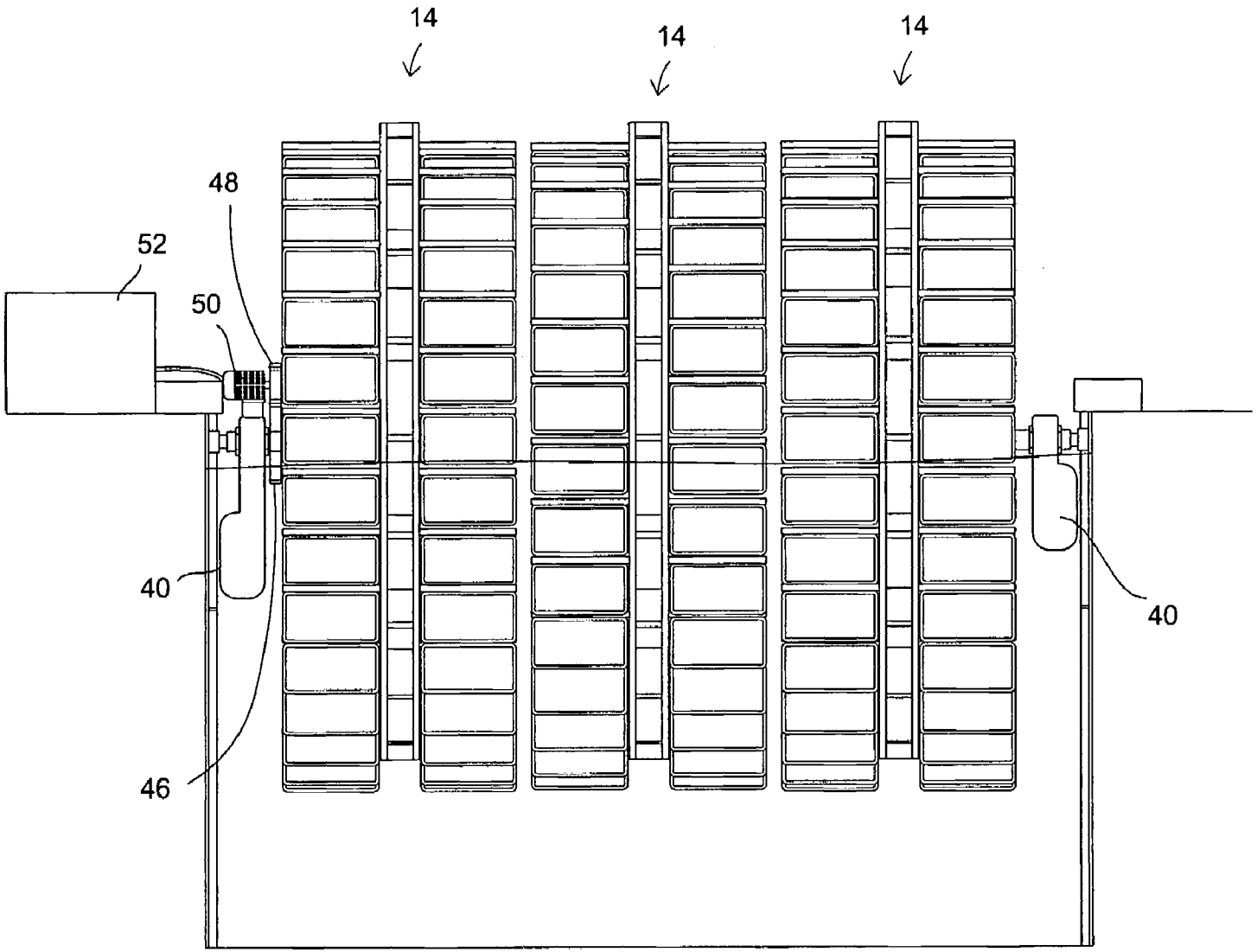
FIG. 3 is similar to FIG. 2 but shows the device lifted as the water level rises.

Referring to FIGS. 1 through 3, there is shown a device 10 for removing small solids from water in a canal 80. The canal 80 is in communication with a waterworks so that the water and solids travel to the waterworks through the canal 80. The device is used in emergency such as during or immediately after a rainstorm when the water is too turbid for the waterworks to process.

The term "small solids" refers to tiny and light particles traveling substantially horizontally with the water in the canal 80. The canal 80 is made with a floor 82, two walls 84 and two banks 86.

The operation of the device 10 requires no or limited energy other than the liquid provides.

The device 10 includes an axle 12 and several rotational filtering units 14 installed on the axle 12. FIG. 1, however, shows only one rotational filtering unit 14 for clarity. The rotational filtering units 14 are arranged across the canal 80 in order to intercept a large proportion of the water and small solids traveling in the canal 80. When impinged by the water and small solids in the canal 80, the rotational filtering units 14 will rotate and filter the small solids. The axle 12 will rotate together with the rotational filtering units 14.

Each of the rotational filtering units 14 includes a waterwheel 16 and many pairs of filters 18. The waterwheel 16 is secured to the axle 12. The filters 18 are installed on the waterwheel 16 pivotally.

Figure 4:
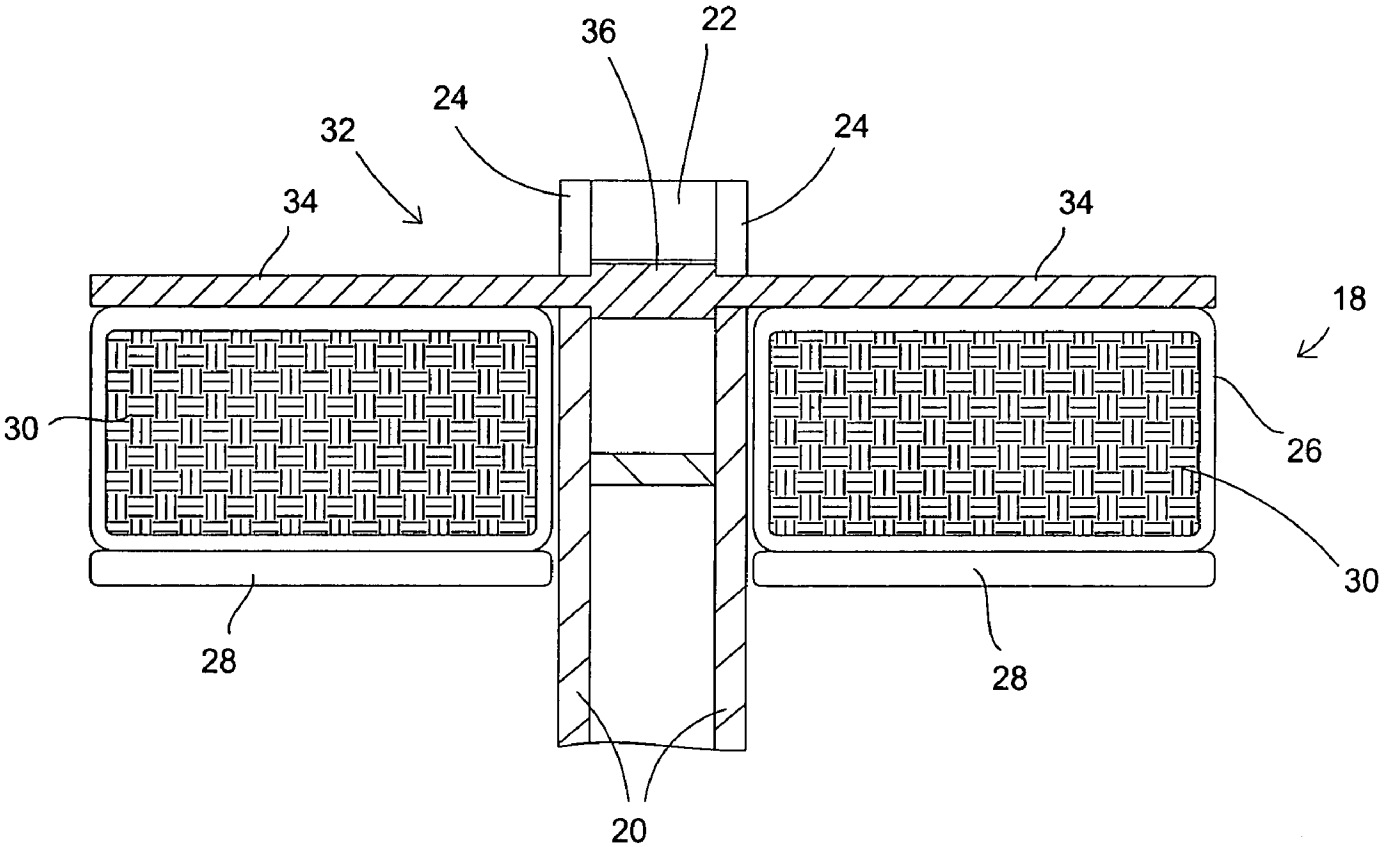
FIG. 4 is a front view of a pair of filters of the device shown in FIG. 1.

Referring to FIG. 4, the waterwheel 16 includes two rims 20 and a plurality of blades 22 between the rims 20. A plurality of recesses 24 is defined in each of the rims 20. The blades 22 and the recesses 24 are arranged in an alternate manner. The waterwheel 16 will rotate as the water and small solids impinge the blades 22.

In the following description, the term "back" means the downstream surface that faces the left in the drawings while the term "front" refers to the upstream surface that faces the right in the drawings.

Each of the filters 18 includes a fabric 30 for intercepting the water and small solids in the canal 80, a frame 26 for supporting the fabric 30 and a weight 28 on the back of the frame 26.

More specifically, the front of the fabric 30 intercepts the water and small solids in the canal 80. The fabric 30 may be Cloth Media® provided by Aqua. As the water travel through the fabric 30, the small solids encounter and adhere to the fabric 30.

For each pair, the frames 26 are connected to a yoke 32. The yoke 32 includes two terminal sections 34 and an enlarged middle section 36 between the terminal sections 34. Each of the frames 26 is connected to one of the terminal sections 34 of the yoke 32.

Figure 5:
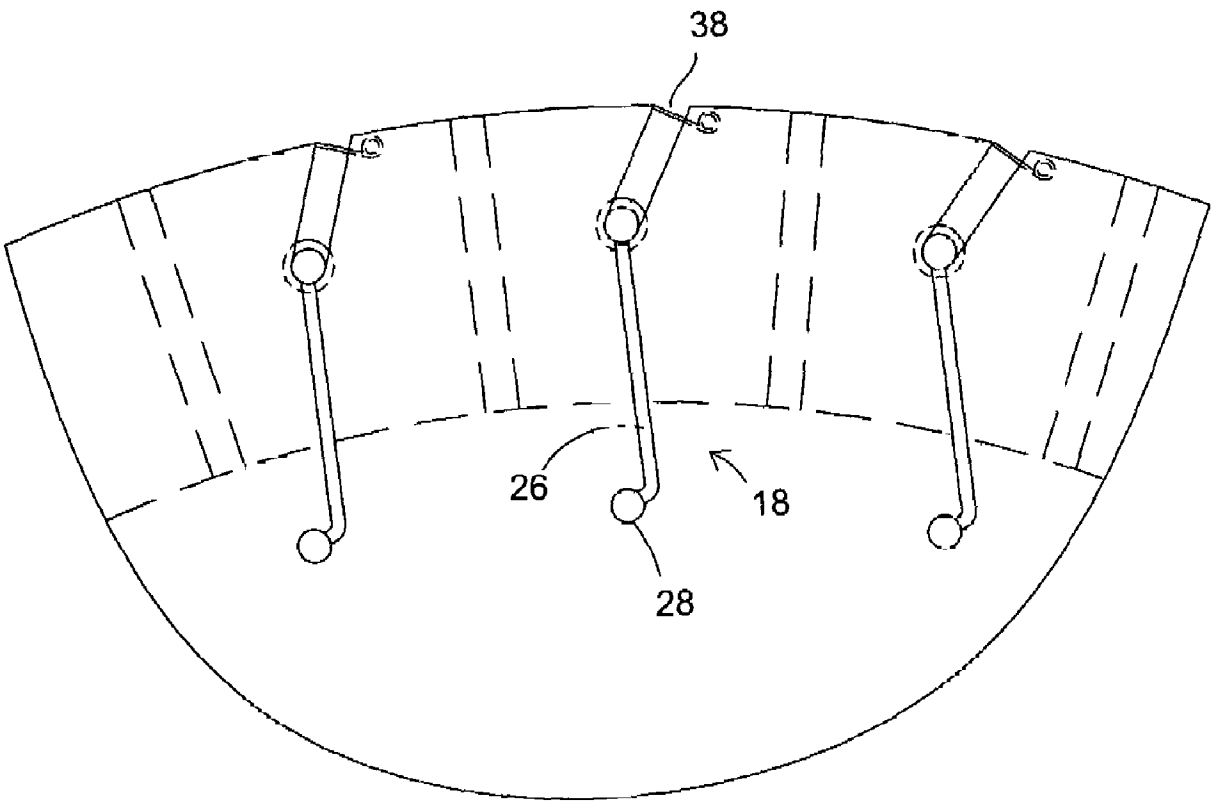
FIG. 5 is a partial side view of a rotational filtering unit used in the device shown in FIG. 1.

Referring to FIGS. 4 and 5, the terminal sections 34 of the yokes 32 are put in the recesses 24 as the middle sections 36 of the yokes 32 are put between the rims 20. Each of the terminal sections 34 of each of the yokes 32 is kept in the related recess 24 by means of an elastic latch 38 installed on one of the rims 20. Each of the elastic latches 38 can be pivoted in order to remove the related yoke 32 from the related recesses 24 so that the pair of filters 18 can be washed. The elastic latches 38 may be spring-loaded metal latches. The middle sections 36 of the yokes 32 are restrained between the rims 20 so that the yokes 32 are prevented from lateral movement.

When above the water and small solids in the canal 80, the fabric 30 will pivot upstream since the weight 28 is formed on the back of the frame 26. When impinged by the water and small solids in the canal 80, the fabric 30 will pivot back. The fabric 30 will extend vertically or still pivot upstream but to a lower degree. Hence, the front of the fabric 30 will intercept the small solids at the right angle.

The solids could soon adhere to and block the fabrics 30. When it happens, the filters 18 will have to be removed from the waterwheel 16 by hand and then washed. The elastic latches 38 ensure convenient removal of the filters 18. After washed, the filters 18 are installed on the waterwheel 16 for use again.

Should the fabrics 30 be blocked and the filters 18 not be removed from the waterwheels 16, the device 10 would not block gravely and endanger the canal 80.

Referring to FIGS. 1 through 3, the axle 12 is installed rotationally on two floats 40. Thus, the rotational filtering units 14 will go up and down when the water level rises and drops. A caster 42 is installed on each end of the axle 12. On the walls 84 of the canal 80 are installed rails 44 for guiding the casters 42. The rails 44 ensure the vertical movement of the axle 12. The casters 42 ensure the smooth movement of the axle 12.

As mentioned above, it is intended that the waterwheel 16 be rotated when rushed by water. However, it may sometimes be necessary to provide a torque to the axle 12. To this end, on the axle 12 is installed a gear 46 engaged with a pinion 48 installed on one of the floats 40. The pinion 48 is driven by means of a motor 50 installed on the same float 40. The motor 50 is electrically connected to a box 52 installed on one of the banks 86 of the canal 80. The motor 50 is powered and controlled by means of the box 52.

As an advantage, the device 10 consumes little energy other than the water provides. Another advantage of the device 10 is the easy installation and removal of the filters 18. As still another advantage, the device 10 can adjust its elevation based on the water level.

The present invention has been described through the detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A device (10) for removing small solids from water, the device (10) comprising an axle (12) and a plurality of rotational filtering units (14) installed on the axle (12) so that while impinged and therefore rotated by the water and small solids, the rotational filtering units (14) filter the small solids, wherein each of the rotational filtering units (14) comprises a waterwheel (16) installed on the axle (12) and a plurality of filters (18) installed on the waterwheel (16) pivotally in order to intercept the small solids at the right angle, wherein each of the rotational filtering units (14) comprises a plurality of yokes (32) pivotally installed on the waterwheel (16) in order to carry a pair of the filters (18) each.

2. The device (10) according to claim 1 wherein the yokes (32) are attached to the waterwheel (16) detachably.

3. The device (10) according to claim 1 wherein the waterwheel (16) comprises two rims (20) each defining a plurality of recesses (24) for receiving the yokes (32).

4. The device (10) according to claim 3 comprising a plurality of elastic latches (38) installed on each of the rims (20) in order to restrain the yokes (32) in the recesses (24).

5. The device (10) according to claim 3 wherein each of the yokes (32) comprises an enlarged middle section (36) restrained between the rims (20).

6. The device (10) according to claim 5 wherein each of the yokes (32) comprises two terminal sections (34) extended from the middle section (36) in order to carry one of the filters (18) each.

7. The device (10) according to claim 6 wherein each of the filters (18) comprises a fabric (30) for filtering the small solids, a frame (26) for supporting the fabric (30), and a weight (28) on the back of the frame (26) so that the front of the fabric (30) can intercept the small solids at the right angle.

8. The device (10) according to claim 1 comprising two floats (40) for supporting the axle (12).

9. The device (10) according to claim 8 comprising two rails (44) installed on the walls (84) of the canal (80) in order to guide the axle (12).

10. The device (10) according to claim 9 wherein comprising two casters (42) connected to the ends of the axle (12) and put movably in the rails (44) in order to ensure the smooth movement of the axle (12).

11. The device (10) according to claim 1 comprising a rotating mechanism for rotating the axle (12).

12. The device (10) according to claim 11 wherein the rotating mechanism comprises a motor (50) and a transmission provided between the motor (50) and the axle (12).

13. The device (10) according to claim 12 wherein the transmission comprises a gear (46) installed on the axle (12) and a pinion (48) engaged with gear (46) and connected to the motor (50).

* * * * *